US005842883A

United States Patent [19]

Igarashi et al.

[11] Patent Number: 5,842,883

[45] Date of Patent: Dec. 1, 1998

[54] CONNECTOR WHICH IS PROVIDED WITH AN OPERATION MEMBER FOR MAKING THE CONNECTOR BE CONNECTED TO A CONNECTION MEMBER

[75] Inventors: Isao Igarashi; Nobukazu Kato, both of Tokyo, Japan

[73] Assignee: Japan Aviation Electronics Industry, Limited, Tokyo, Japan

[21] Appl. No.: 690,229

[22] Filed: Jul. 19, 1996

[30] Foreign Application Priority Data

Sep. 29, 1995 [JP] Japan ..... 7-254177

[51] Int. Cl.[6] ..... H01R 9/07

[52] U.S. Cl. ..... 439/495; 439/260

[58] Field of Search ..... 439/492, 493, 439/495, 259, 260, 67, 77, 630, 329, 341

[56] References Cited

U.S. PATENT DOCUMENTS 5,240,430 8/1993 Soes ..... 439/495

5,639,260 6/1997 McHugh ..... 439/495

*Primary Examiner*—Gary F. Paumen

*Assistant Examiner*—Yong Ki Kim

*Attorney, Agent, or Firm*—Laff, Whitesel, Conte & Saret, Ltd.

[57] ABSTRACT

In a connector for use in connecting a connection member (33) of a sheet-like having first and second surfaces opposite to each other in a predetermined direction, a contact member (35) is provided with a first arm portion (53) extending to face the first surface and a second arm portion (54) connected to the first arm portion and extending to face the second surface. The first arm portion is for engaging with an operation member (39) to be moved by manual operation of the operation member in the predetermined direction. The second arm portion moves together with the first arm portion to become in contact with the second surface of the connection member. When the first arm portion is moved, bending is caused in a bendable portion (47) extending from a fixed portion (32) which is fixed to an insulator (31).

12 Claims, 5 Drawing Sheets

CONNECTOR WHICH IS PROVIDED WITH AN OPERATION MEMBER FOR MAKING THE CONNECTOR BE CONNECTED TO A CONNECTION MEMBER

BACKGROUND OF THE INVENTION

The present invention relates to a connector and, more specifically, to a ZIF (zero insertion force) connector, requiring a low insertion force, to be used in connecting a sheet-like connection member, such as an FPC (flexible printed circuit) or a flat ribbon cable.

Various connectors are known as such a ZIF connector. A particular one of the connectors comprises an insulator, a contact member held by the insulator, and an operation member for bringing the connection member into contact with the contact member.

Generally, the operation member is movable between first and second positions. The insulator can receive the connection member while the operation member is at the second position. After the insulator receives the connection member, an operator moves the operation member from the second position to the first position. At the first position, the operation member presses the connection member towards a contact portion of the contact member. As a result, the connection member becomes in contact with the contact portion with elastic bending of the contact member.

However, for ensuring the necessary pressing force of the contact portion against the connection member, the large elasticity needs to be given to the contact member. This, in turn, requires a large force for moving the operation member between the first and the second positions.

SUMMARY OF THE INVENTION

It is therefore an object of the present invention to provide a connector which is excellent in handling of an operation member, as compared with the foregoing conventional connector.

Other objects of this invention will become clear as the description proceeds.

According to an aspect of the present invention, there is provided a connector for use in connecting a connection member of a sheet-like having first and second surfaces opposite to each other in a predetermined direction. The connector comprises an insulator for receiving the connection member, a contact member held by the insulator, and an operation member manually operable. In the connector, the contact member comprises a fixed portion fixed to the insulator, a bendable portion being bendable and extending from the fixed portion to have an extended end, a first arm portion extending from the extended end to face the first surface and being for engaging with the operation member to be moved by manual operation of the operation member in the predetermined direction with bending of the bendable portion, and a second arm portion connected to the first arm portion to face the second surface and being moved together with the first arm portion.

According to another aspect of the present invention, there is provided a connector comprising an insulator for receiving therein a connection member of a sheet-like having first and second surfaces opposite to each other in a predetermined direction, a contact member fixedly held by the insulator, the contact member having a pivot portion facing the first surface and a contact portion connected to the pivot portion for abutment with the second surface, and an operation member engaging with the pivot portion so as to be turnable about the pivot portion, wherein the pivot portion is movable in the predetermined direction together with the contact portion.

DESCRIPTION OF THE PREFERRED EMBODIMENTS

Figure 1:
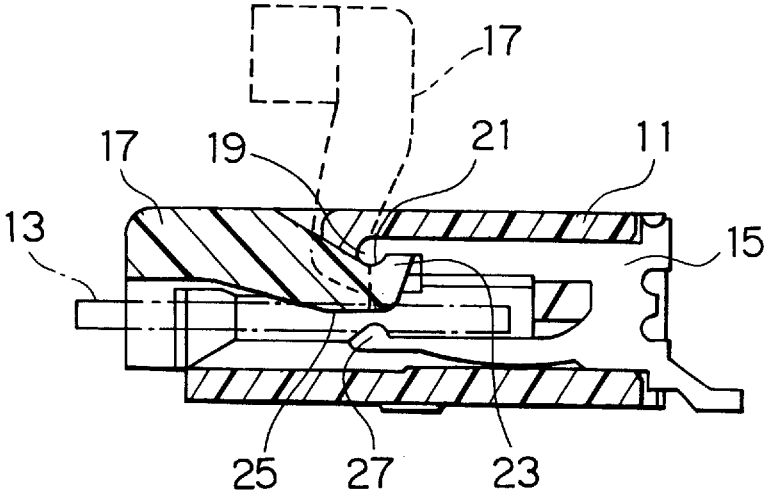
PRIOR ART FIG. 1
FIG. 1 is a side sectional view of a conventional connector.
Figure 2:
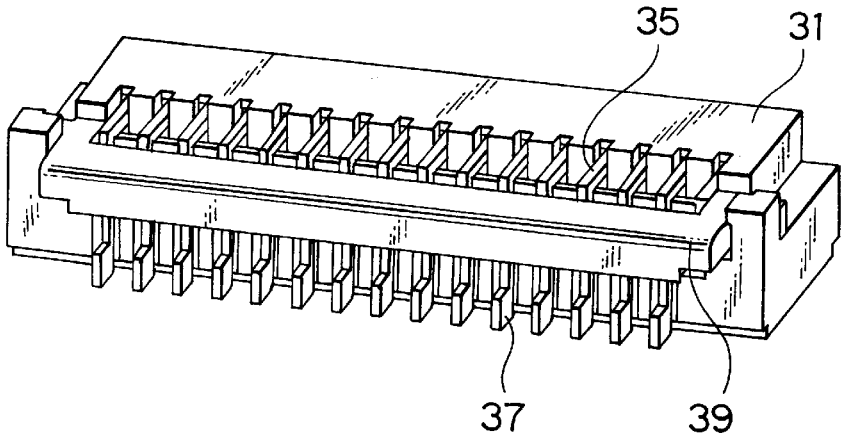
FIG. 2 is a perspective view showing a connector according to a first embodiment of the present invention, wherein an operation member is set in a first (closed) position.

Referring to FIG. 1, description will be made at first as regards a conventional connector for a better understanding of this invention. The conventional connector includes an insulator 11 into which an FPC 13 is inserted as shown by a long and short dash line, a plurality of contact members 15 arranged at regular intervals and fixedly held by the insulator 11, and an operation member 17 engaging with pivot portions 19 of the contact members 15.

Each of the pivot portions 19 has an outer periphery of a circular arc in section. The operation member 17 is formed with a concave portion 21 of a circular arc in section which fitly receives therein the pivot portions 19. With this arrangement, the operation member 17 is turnable or pivotal about the pivot portions 19 between a first position shown by a broken line and a second position shown by a solid line.

The operation member 17 has a temporarily retaining portion 23 for temporarily retaining the FPC 13 in cooperation with the contact members 15 while the operation member 17 is in the foregoing first position. The operation member 17 further has a retaining portion 25 for retaining the FPC 13 by pressing it onto contact portions 27 of the contact members 15 while the operation member 17 is in the foregoing second position.

In the foregoing conventional connector, the FPC 13 is insertable into the insulator 11 while the operation member 17 is in the foregoing first position. After insertion, the operation member 17 is turned from the first position to the second position. During that event, as being pressed by an angular portion of the periphery of the operation member 17, the FPC 13 received in the insulator 11 and the contact portions 27 located on the underside of the FPC 13 are elastically deformed or displaced downward. Then, when the operation member 17 reaches the second position, the contact portions 27 are pressed against the underside of the FPC 13 due to the elasticity of the contact portions 27.

However, in the foregoing conventional connector, for ensuring the necessary pressing force of the contact portions 27 against the FPC 13, the large elasticity needs to be given to the contact portions 27. This, in turn, requires a large insertion force for inserting the FPC 13 into the insulator 11 and thus makes it difficult to insert the FPC 13 into the connector.

Referring to FIGS. 2 through 6, the description will now be made as regards a connector according to a first embodiment of the present invention. The connector includes an insulator 31 into which the FPC 33 is inserted, a plurality of primary contact members 35 fixedly held by the insulator 31, a plurality of secondary contact members 37 fixedly held by the insulator 31, and an operating member 39 engaging with pivot portions 41 of the primary contact members 35 so as to turnable or pivotal thereabout. The FPC 33 is referred to as a connection member and has first and second surfaces opposite to each other in a predetermined direction.

Figure 3:
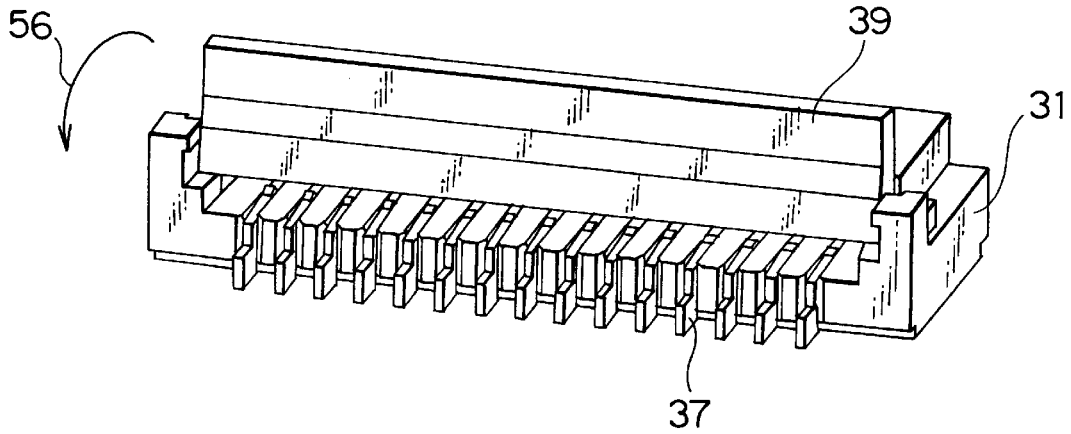
FIG. 3 is a perspective view showing the connector of FIG. 2, wherein the operation member is set in a second (opened or upright) position.
Figure 4:
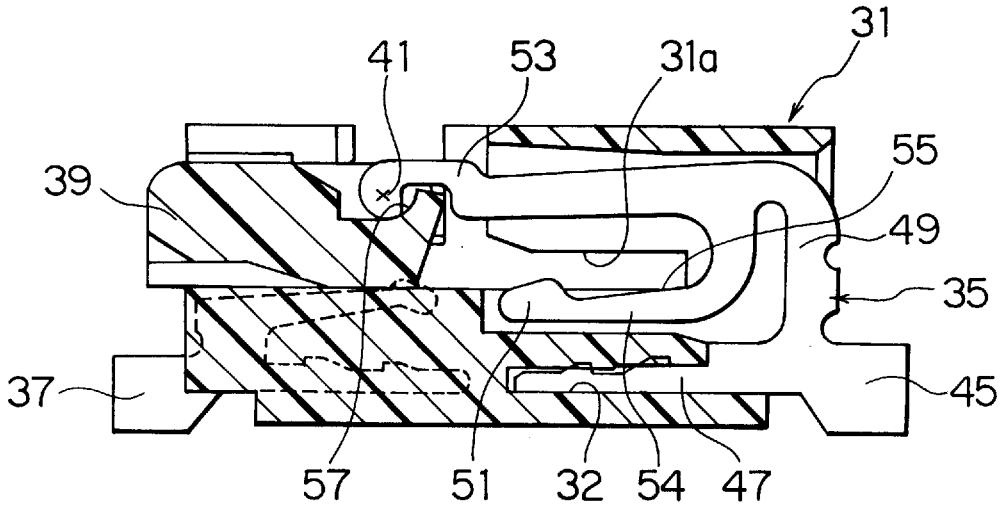
FIG. 4 is a side sectional view of the connector of FIG. 2, wherein the operation member is set in the first position.
Figure 5:
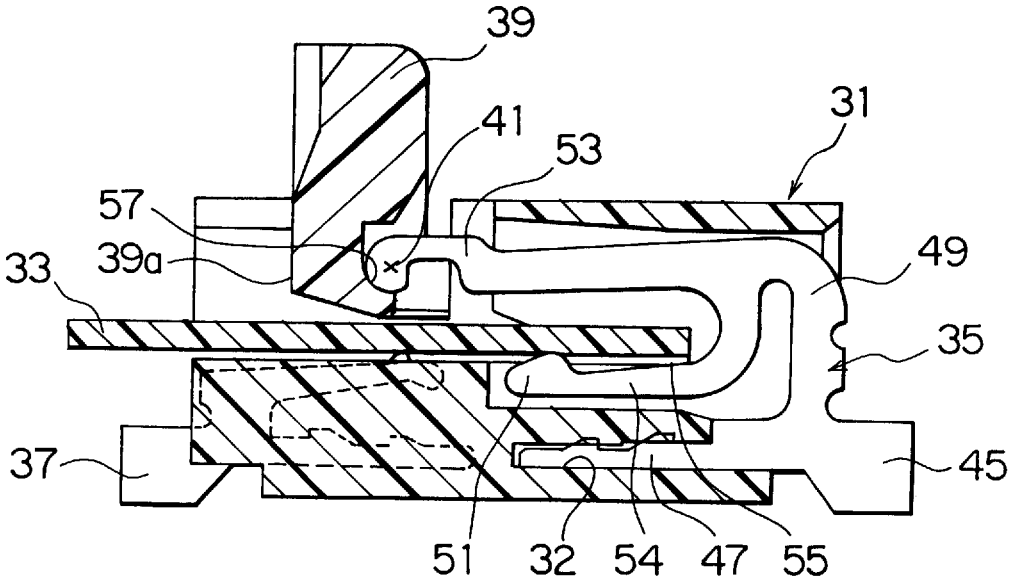
FIG. 5 is a side sectional view of the connector of FIG. 1, wherein the operation member is set in the second position with an FPC being inserted into the connector.

The primary contact members 35 and the secondary contact members 37 are arranged in a direction orthogonal to the drawing sheet in FIGS. 3 to 5 at regular pitches which are equal to those of conductors 43*a* and 43*b* (see FIG. 7) printed on the second surface, namely, an underside of the FPC 33, respectively. Each of the contact members 35 and 37 includes a soldering portion 45 projecting outward of the insulator 31. The primary contact member 35 bifurcates from the soldering portion 45 into a lower branch 47 and an upper branch 49. The lower branch 47 is formed with a press-in portion which is press-fitted into a contact fixing hole 32 of the insulator 31. Thus, the lower branch 47 is referred to as a fixed portion fixed to the insulator 31.

On the other hand, the upper branch 49 is bendable and is referred to as a bendable portion which upwardly extends from the lower branch 47 to have an extended end at an upper portion thereof. A turn shaft portion 53 extends from the extended end of the upper branch 49 to face the first surface of the FPC 33 and has one of the pivot portions 41. The turn shaft portion 53 is referred to as a first arm portion.

From an intermediate portion of the turn shaft portion 53, a second arm portion 54 extends to face the underside of the FPC 33. The second arm portion 54 comprises a contact portion 51 provided for abutment with the corresponding conductor 43*a* on the underside of the FPC 33. The contact portion 51 is arranged so as to be exposed to a receiving space 55 formed in the insulator 31, and further arranged so as to be separated from a corresponding bottom wall of the insulator 31. With this arrangement, the contact portion 51 is given the elasticity in the upward and downward directions and thus is elastically deformable in those directions. The turn shaft portion 53 extends substantially in parallel with the second arm portion 54 and is formed with the foregoing pivot portion 41 at its tip. The soldering portion 45 is soldered, for example, to a pattern on a printed board (not shown) arranged at the bottom of the connector.

Figure 6:
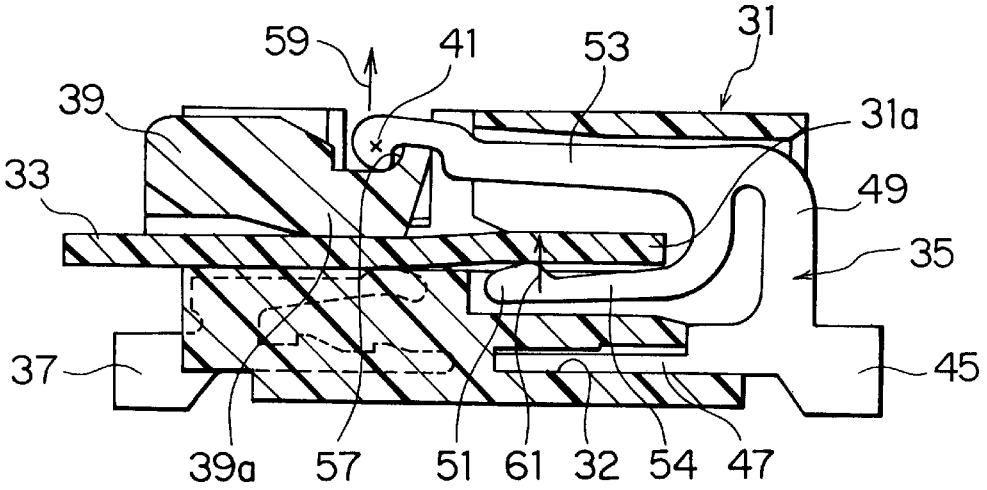
FIG. 6 is a side sectional view showing the connector of FIG. 1, wherein the operation member is set in the first position after insertion of the FPC.

The upper side of the turn shaft portion 53 is not covered by the insulator 31. Thus, the turn shaft portion 53 including the pivot portion 41, which is given the elasticity in the upward and downward directions, is elastically deformable in those directions as shown in FIGS. 4 to 6. As shown in the figures, the pivot portion 41 is provided above the contact portion 51.

As shown by solid and broken lines in FIGS. 4 to 6, each of the secondary contact members 37 is essentially the same as each of the primary contact members 35 without the upper branch, including the turn shaft portion 53 and the pivot portion 41, of the upper branch 49.

The operation member 39 is formed with a concave portion 57 of an essentially circular arc in section which engages with the pivot portions 41 so that the operation member 39 is turnable or pivotal about the pivot portions 41.

Specifically, the operation member 39 is arranged to turn or displace from a position (which will be called hereinunder a second position) shown in FIG. 5 to a position (which will be called hereinunder a first position) shown in FIG. 4 or 6. As shown in FIG. 5, when the operation member 39 is set in the second position, an opening is formed for the receiving space 55 of the insulator 31 so that the FPC 33 is insertable into the receiving space 55 via this opening. On the other hand, as shown in FIG. 6, when the operation member 39 is set in the first position, the contact members 35 and 37 are pressed upon the underside of the FPC 33.

Figure 7:
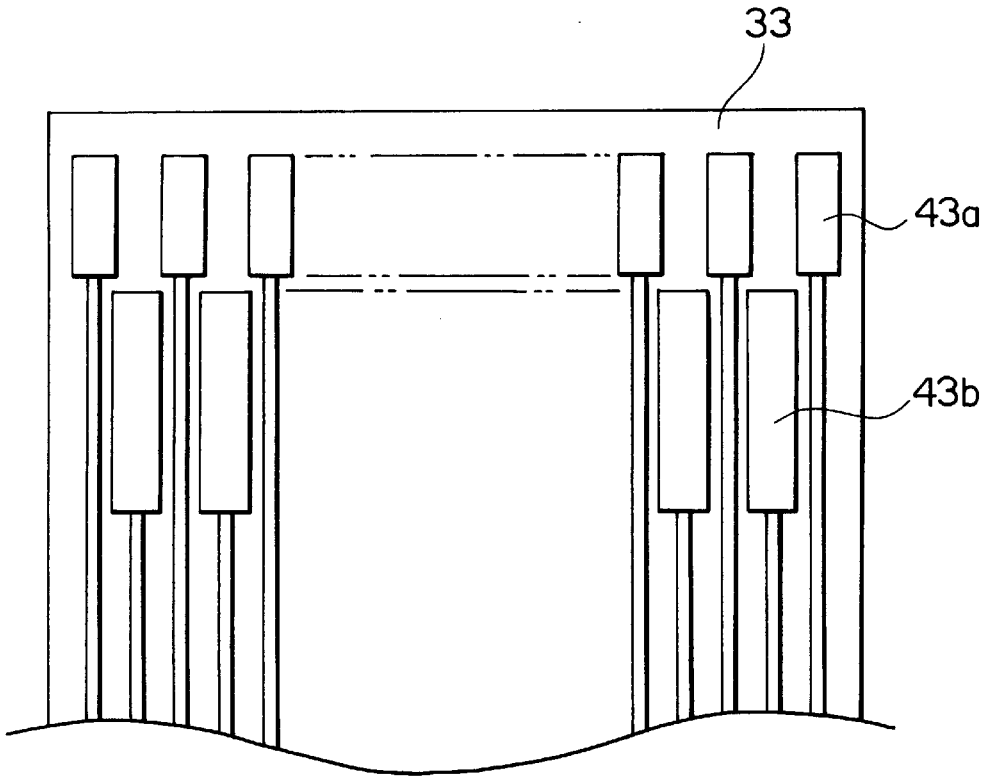
FIG. 7 is a plan view for explaining the FPC to be inserted into the connector.

The FPC 33 is inserted into the receiving space 55 of the insulator 31 from the front of the connector via the foregoing opening. As shown in FIG. 7, on the underside of the insertion tip side of the FPC 33, the conductors 43*a* and 43*b* are printed at regular pitches, respectively. The conductors 43*a* are for connection to the contact portions 51 as described above, while the conductors 43*b* are for connection to contact portions of the contact members 37.

Now, a procedure for connecting the FPC 33 in the connector having the foregoing structure will be described hereinbelow.

First, at the second position where the operation member 39 is turned upward as shown in FIGS. 3 and 5, the FPC 33 is inserted into the connector via the foregoing opening of the receiving space 55 formed in the insulator 31. Since each of the contact portions 51 is located at its lowermost position when the operation member 39 is set in the second position, the FPC 33 can be inserted with a ZIF or a low insertion force. On the other hand, it may also be arranged that a distance between an upper end of each contact portion 51 and an upper inner surface of the receiving space 55 is set slightly shorter than a thickness of the FPC 33 so as to temporarily retain the inserted FPC 33 therebetween. With this arrangement, the insertion of the FPC 33 in an inclined posture can be prevented.

Subsequently, the operation member 39 is turned by manual operation thereof about the pivot portion 41 in a direction of an arrow 56, that is, in a counter-clockwise direction, in FIG. 3. Through this operation, the operation member 39 is displaced from the second position shown in FIG. 5 to the first position shown in FIG. 6. Then, each turn shaft portion 53 along with the pivot portion 41 is displaced upward in a direction of an arrow 59 due to the elastic deformation thereof through engagement with the tip of the operation member 39. In other words, the operation member 33 urges at the first position each turn shaft portion 53 in the predetermined direction. As a result, the turn shaft member 53 is moved in the predetermined direction with bending of the lower branch 47.

Simultaneously, each contact portion 51 is displaced upwardly in a direction of an arrow 61, following the elastic deformation of the turn shaft portion 53 including the pivot portion 41. As a result, the contact portions 51 are pressed against the corresponding conductors 43*a* of the FPC 33. In this event, the first surface of the FPC 33 is received by a receiving surface 31*a* of the insulator 31.

Further, a holding portion 39*a* of the operation member 39 presses the FPC 33 downward in its second position as shown in FIG. 6. As a result, the holding portion 39*a* holds the FPC 33 in cooperation with the insulator 31. Simultaneously, the conductors 43*a* of the FPC 33 are pressed against the corresponding contact portions of the secondary contact members 37.

Figure 8:
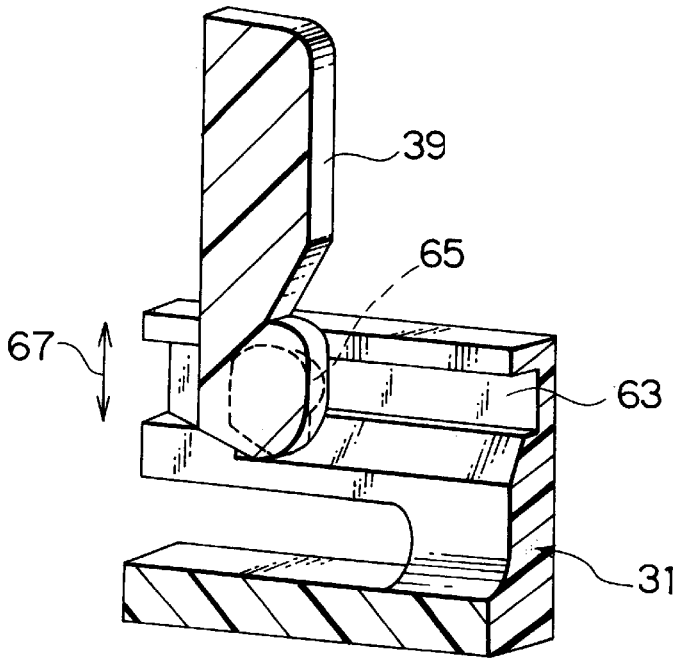
FIG. 8 is a perspective view showing a main portion of a connector according to a second preferred embodiment of the present invention.
Figure 9:
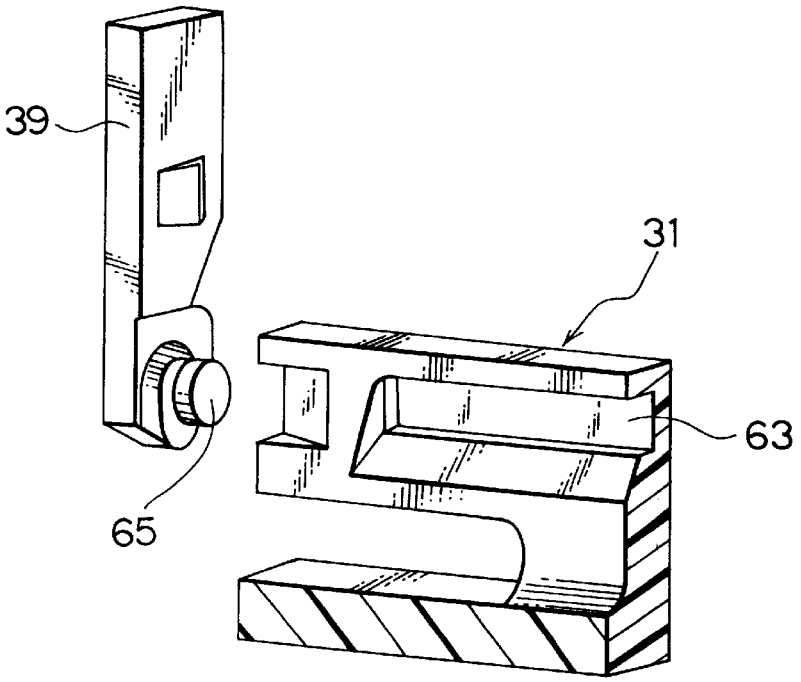
FIG. 9 is an exploded perspective view showing the connector of FIG. 8.

Turning to FIGS. 8 and 9, the description will be directed to a connector according to a second embodiment of the present invention. In the connector, in addition to the foregoing elastic deformation of the primary contact members 35, bearing portions 63 are formed on both sides of the insulator 31 for rotatably holding end portions 65 of the operation member 39 and are arranged to be elastically deformable or bendable as shown by an arrow 67 in FIG. 8, following movement of the end portions 65. This arrangement can be easily achieved by forming the whole insulator 31 or only the bearing portions 63 of, for example, synthetic resin which is elastically deformable. A combination of the bearing portions 63 and the end portions 65 will be referred to as a supporting arrangement for supporting the operation member 39 to the insulator 31 so as to pivotally move around an axis extending parallel to the first surface of the FPC 33. Elastical bending of the insulator 31 will be referred to as an axis movement arrangement.

It may be further arranged that a height of a groove formed at each bearing portion 63 is set greater than a diameter of each end portion 65 of the operation member 39 so as to provide an escape for the end portion 65 to move upward while the operation member 39 is turned.

As described above, the pivot portion 41 (the turn shaft portion 53) and the contact portion 51 are formed on the same branch 47 of each primary contact 35. Thus, when the operation member 39 is turned from the second position to the first position, the pivot portion 41 and the contact portion 51 are moved in the same direction. Through this operation, the contact portions 51 move toward the FPC 33 so as to be pressed against the underside thereof. Further, since the contact portions 51 are moved in the same direction as the pivot portions 41, the elasticity of each primary contact member 35 can be set smaller. Thus, the FPC 33 can be inserted into the connector with a ZIF or a low insertion force so that the handling of the connector is improved.

While the present invention has thus far been described in connection with a few embodiments thereof, it will readily be possible for those skilled in the art to put this invention into practice in various other manners. For example, the operation member may be designed to move the pivot portion or the turn shaft portion in the predetermined direction in accordance with movement thereof along the FPC. The connector can be used to connect a flat ribbon cable instead of the FPC.

What is claimed is:

1. A connector for use in connecting a sheet-like connection member having first and second surfaces opposite to each other in a predetermined direction, said connector comprising an insulator for receiving said connection member, a contact member held by said insulator, and an operation member manually operable, said contact member comprising:

a fixed portion fixed to said insulator;

a bendable portion being bendable and extending from said fixed portion to have an extended end;

a first arm portion extending from said extended end to face said first surface and being for engaging with said operation member to be moved by manual operation of said operation member in said predetermined direction with bending of said bendable portion;

a second arm portion connected to said first arm portion and extending to face said second surface, said second arm being moved together with said first arm portion;

wherein said operation member is movable between a first position where said operation member is placed between said first arm portion and said first surface of the connection member and a second position displaced from said first position, and said operation member urging, when said operation member is at said first position, said first arm portion in said predetermined direction to make said second arm portion become into contact with said second surface of the connection member.

2. A connector as claimed in claim 1, wherein said second arm portion comprises a contact portion which is brought into contact with said second surface of the connection member responsive to the movement of said first arm portion.

3. A connector as claimed in claim 1, wherein said insulator has a contact fixing hole, said fixed portion being pressedly fitted into said contact fixing hole to thereby be fixed to said insulator.

4. A connector as claimed in claim 1, wherein said operation member further comprises a holding portion for holding said connection member in cooperation with said insulator.

5. A connector as claimed in claim 1, wherein said insulator has a receiving surface which is opposite to said contact portion for receiving said first surface of the connection member.

6. A connector as claimed in claim 1, wherein said first arm portion has a pivot portion, said operation member engaging with said pivot portion to pivotally move around said pivot portion between said first and said second positions.

7. A connector as claimed in claim 6, further comprising supporting means connected to said operation member and said insulator for supporting said operation member to said insulator so as to pivotally move around an axis extending parallel to said first surface of the connection member.

8. A connector as claimed in claim 7, further comprising axis movement means connected to said supporting means for moving said axis in response to the movement of the first arm portion in the predetermined direction.

9. A connector comprising:

an insulator for receiving therein a connection member of a sheet-like having a first and a second surface opposite to each other in a predetermined direction;

a contact member fixedly held by said insulator, said contact member having a pivot portion facing said first surface and a contact portion connected to said pivot portion for abutment with said second surface; and an operation member engaging with said pivot portion so as to be turnable about said pivot portion, wherein said pivot portion is movable in said predetermined direction together with said contact portion.

10. A connector as claimed in claim 9, wherein said operation member is turnable between a first position where said connection member inserted in said insulator is held in pressed abutment with said contact member and a second position where said connection member is insertable into said insulator, and wherein, when said operation member is at said first position, said operation member pushes and moves said pivot portion, which movement of said pivot portion causes said contact portion to move so that said contact portion is pressed against said second surface of the connection member.

11. A connector as claimed in claim 9, wherein said operation member has end portions which are rotatably held at bearing portions formed on both sides of said insulator, respectively, and wherein said bearing portions are elastically deformable following movement of said end portions.

12. A connector as claimed in claim 9, wherein said operation member has end portions which are rotatably held at bearing portions formed on both sides of said insulator, respectively, and wherein each of said bearing portions is provided with an escape for said end portion while said operation member is turned.

* * * * *